US005552859A

United States Patent [19]

Nakagawa et al.

[11] Patent Number: 5,552,859

[45] Date of Patent: Sep. 3, 1996

[54] SHEET SUPPLYING APPARATUS WITH MEANS FOR ROCKING SHEET STACKING PLATE

[75] Inventors: Tomohito Nakagawa, Matsudo; Masakazu Hiroi, Yokohama; Kazuhiro Matsuo, Tokyo; Hideki Orii, Yamanashi-ken; Satoru Kato, Yamanashi-ken; Akihito Dobashi, Yamanashi-ken; Mamoru Noda, Yamanashi-ken, all of Japan

[73] Assignee: Canon Kabushiki Kaisha, Tokyo, Japan

[21] Appl. No.: 383,432

[22] Filed: Feb. 3, 1995

[30] Foreign Application Priority Data

Feb. 8, 1994 [JP] Japan ..... 6-036573
Feb. 8, 1994 [JP] Japan ..... 6-036574

[51] Int. Cl.[6] ..... G03G 15/00; B65H 5/06

[52] U.S. Cl. ..... 355/207; 355/309; 271/110; 271/153

[58] Field of Search ..... 355/205, 206, 355/207, 309; 271/110, 152, 153, 155

[56] References Cited

U.S. PATENT DOCUMENTS 4,220,324 9/1980 Weller ..... 271/152 X
4,365,795 12/1982 Fukushima et al. ..... 271/236
4,544,148 10/1985 Kitajima et al. ..... 271/3.05
5,132,741 7/1992 Kitajima et al. ..... 355/309
5,149,049 9/1992 Nemura et al. ..... 248/674
5,213,320 5/1993 Hirota et al. ..... 271/110 X
5,293,196 3/1994 Kaneko et al. ..... 355/206 X

FOREIGN PATENT DOCUMENTS 5-132196 5/1993 Japan .

*Primary Examiner*—Joan H. Pendegrass
*Assistant Examiner*—Sophia S. Chen
*Attorney, Agent, or Firm*—Fitzpatrick, Cella, Harper & Scinto

[57] ABSTRACT

A sheet supplying apparatus has a sheet stacking plate on which sheets are stacked, a drive unit for vibrating the sheet stacking plate upwardly and downwardly, and a sheet supply mechanism for supplying the sheet from the sheet stacking plate. A sheet supplying condition detecting device detects poor supply of a sheet bundle, and the drive unit is operated on the basis of a detection signal of the sheet supplying condition detecting device so that clogging of the sheets, poor sheet separation and poor sheet supply can be prevented.

33 Claims, 13 Drawing Sheets

SHEET SUPPLYING APPARATUS WITH MEANS FOR ROCKING SHEET STACKING PLATE

BACKGROUND OF THE INVENTION

1. Field of the Invention

The present invention relates to a sheet supplying apparatus and an image forming apparatus, and more particularly, it relates to a sheet supplying apparatus particularly used as an automatic document (original) feeder for an image forming apparatus such as a copying machine, and an image forming apparatus having such a sheet supplying apparatus.

2. Related Background Art

In a conventional sheet supplying apparatus having a movable sheet (original) stacking plate, as disclosed in U.S. Pat. No. 5,132,741 (granted on Sep. 18, 1992), sheets stacked on the stacking plate are separated one by one, and the separated sheet is sent onto a platen of an image forming apparatus to read an image on the sheet, and, after the image was read, the sheet is discharged from the platen and is re-stacked on the sheet stacking plate. Further, in such a sheet supplying apparatus, switch-back path and a closed loop path are selectively switched in accordance with a size of the sheet so that, when the closed loop path is used, after the sheet stacking plate is moved to a lower position, the above-mentioned fundamental operations are effected.

In the above-mentioned conventional sheet supplying apparatus, when the sheet are stacked and the supplying operation is started, as shown in FIG. 15, normally, in order to separate and supply a stack of sheets P set on the sheet stacking plate 101, a sheet supply roller 102 is firstly rotated in a direction shown by the arrow, and at the same time, a weight 106 for urging the sheet stack is driven in a direction shown by the arrow, with the result that the sheet(s) is sent to a nip between a separation and convey roller 103 and a separation belt 104 for preventing double-feed of sheets. The sheet separated by the separation and convey roller 103 and the separation belt 104 is conveyed downstreamly in a sheet conveying direction. However, in this conventional sheet supplying apparatus, if a large number (for example, 100 or more) of sheets are stacked on the sheet stacking plate 101, since a contacting force between the sheets is often increased due to weights of the sheets themselves, when the sheet supply roller 102 is driven, the sheet stack is sent to the separating station at a time, with the result that the sheet stack is pinched and locked between a separation regulating plate 105 for defining a path in the separating station and the sheet stacking plate 101, thereby causing the poor sheet supply. If such poor sheet supply occurs, in the sheet supplying apparatus, since the sheet does not pass by a separation sensor 107 within a predetermined time period, the sheet supplying and separation operations must be stopped in consequence of delay of separation.

SUMMARY OF THE INVENTION

The present invention aims to eliminate the above-mentioned conventional drawback, and has an object to provide a sheet supplying apparatus and an image forming apparatus which can supply a sheet positively.

Another object of the present invention is to provide a sheet supplying apparatus and an image forming apparatus having such a sheet supplying apparatus. Wherein, if a sheet stack is clogged in a separating station, such a clogged condition can be detected, and the clogged condition can be released to continue sheet separating and supplying operations.

According to one aspect of the present invention, there is provided a sheet supplying apparatus comprising a sheet stacking plate on which sheets are stacked, drive means for shifting the sheet stacking plate upwardly and downwardly, and sheet supply means for supplying the sheet from the sheet stacking plate. Wherein the drive means is driven after a predetermined time period is elapsed.

According to another aspect of the present invention, there is provided a sheet supplying apparatus comprising a sheet stacking plate on which sheets are stacked, drive means for shifting the sheet stacking plate upwardly and downwardly, and sheet supply means for supplying the sheet from the sheet stacking plate. It further comprises a sheet supplying condition detecting means for detecting poor supply of a sheet stack and the drive means is operated on the basis of a detection signal from the sheet supplying condition detecting means.

The sheet supplying condition detecting means serves to detect a load acting on the sheet supply means so that, when a detected value exceeds a predetermined value, the drive means is operated. Further, the sheet supplying condition detecting means comprises a torque sensor for detecting a current value of a sheet supply drive motor constituting the sheet supply means.

Furthermore, the sheet supplying condition detecting means may comprise a separation sensor disposed at a downstream side of the sheet supply means in a sheet conveying direction, and an urging means for increasing a sheet supplying force of the sheet supplying means. During the operation of the sheet supply means, when the sheet does not pass by the sheet sensor after a predetermined time period is elapsed, the urging means is operated, and, when the sheet is not detected by the separation sensor after a predetermined time period from the initiation of operation of the urging means is elapsed, the drive means is operated.

Incidentally, in an image forming apparatus according to the present invention, after the sheet is supplied from the sheet stacking plate onto a platen by the above-mentioned sheet supplying apparatus, an image is formed on a recording medium.

If a plurality of sheets are simultaneously sent to the sheet supply means to cause a clogged or locked condition, the drive means is operated on the basis of the detection signal of the sheet supplying condition detecting means to shift the sheet stacking plate in the vertical direction, thereby displacing the sheets in the sheet stack along the sheet conveying direction, with the result that the locked condition is automatically eliminated, thus continuing the sheet supplying operation.

In the present invention, since the drive means is operated after the predetermined time period is elapsed so that the sheet stacking plate is shifted in the vertical direction, the sheet stack clogged or locked in the sheet supply means can be released automatically, thereby permitting the smooth sheet supplying operation.

Further, if the plurality of sheets are clogged or locked in the sheet supply means, the locked condition is detected by the sheet supplying condition detecting means. As a result, since the drive means is operated on the basis of the detection signal of the sheet supplying condition detecting means to shift the sheet stacking plate in the vertical direction, thereby displacing the sheets in the locked sheet stack along the sheet conveying direction to automatically eliminate the locked condition, the sheet supplying and separating operations can be continued.

Further, by providing the sheet supplying apparatus capable of automatically eliminating the locked condition to continue the sheet supplying and separating operations in association with an image forming apparatus, an image forming operation can be effected continuously and reliability of the image forming apparatus can be improved.

DETAILED DESCRIPTION OF THE PREFERRED EMBODIMENTS

The present invention will now be explained in connection with embodiments thereof with reference to the accompanying drawings.

Figure 1:
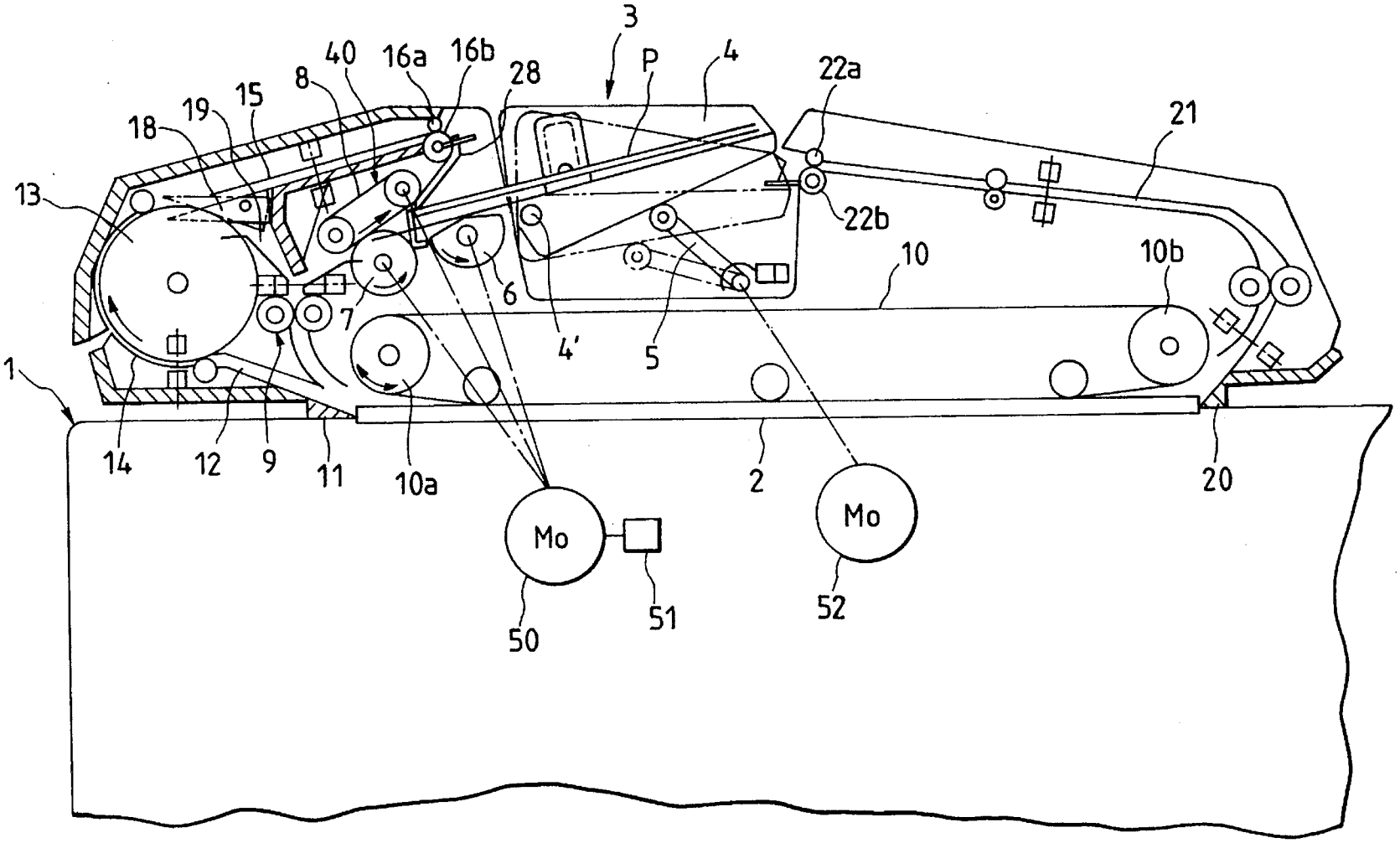
FIG. 1 is a sectional view of a sheet supplying apparatus according to a preferred embodiment of the present invention.

FIG. 1 shows a sheet supplying apparatus 3 rested on a platen 2 of an image forming apparatus 1. The sheet supplying apparatus 3 is provided at its upper part with a tray (sheet stacking plate) 4 acting as a sheet stacking plate and sheet discharge plate which can be shifted upwardly and downwardly by a lift/lower rink 5. The tray 4 is pivotally mounted on a shaft 4'. Incidentally, the lift/lower rink 5 is driven by a DC motor 52, and a drive means is constituted by the lift/lower rink 5 and the DC motor 52. A semicircular sheet supply roller 6, a convey roller 7 and a separation belt 8, and a pair of regist rollers 9 are arranged in order along a sheet supplying direction. An endless wide belt 10 mounted around a pair of rollers 10*a*, 10*b* is disposed on the plate 2. Incidentally, an additional stationary tray 31 is disposed at a downstream side of the tray 4.

Further, there are provided a convey path 12 connected a left end of the platen 2 through a jump portion 11, a convey path 14 disposed around a large diameter roller 13, and a convey path 15 having a free end at which a pair of discharge rollers 16*a*, 16*b* are arranged. When a flapper 18 is switched to a position shown by the dot and chain line, a sheet original (not shown) is introduced from the convey path 14 into a convey path 19 where the sheet original is turned-over, and the turned-over sheet original is sent onto the plate 2 again.

Figure 2:
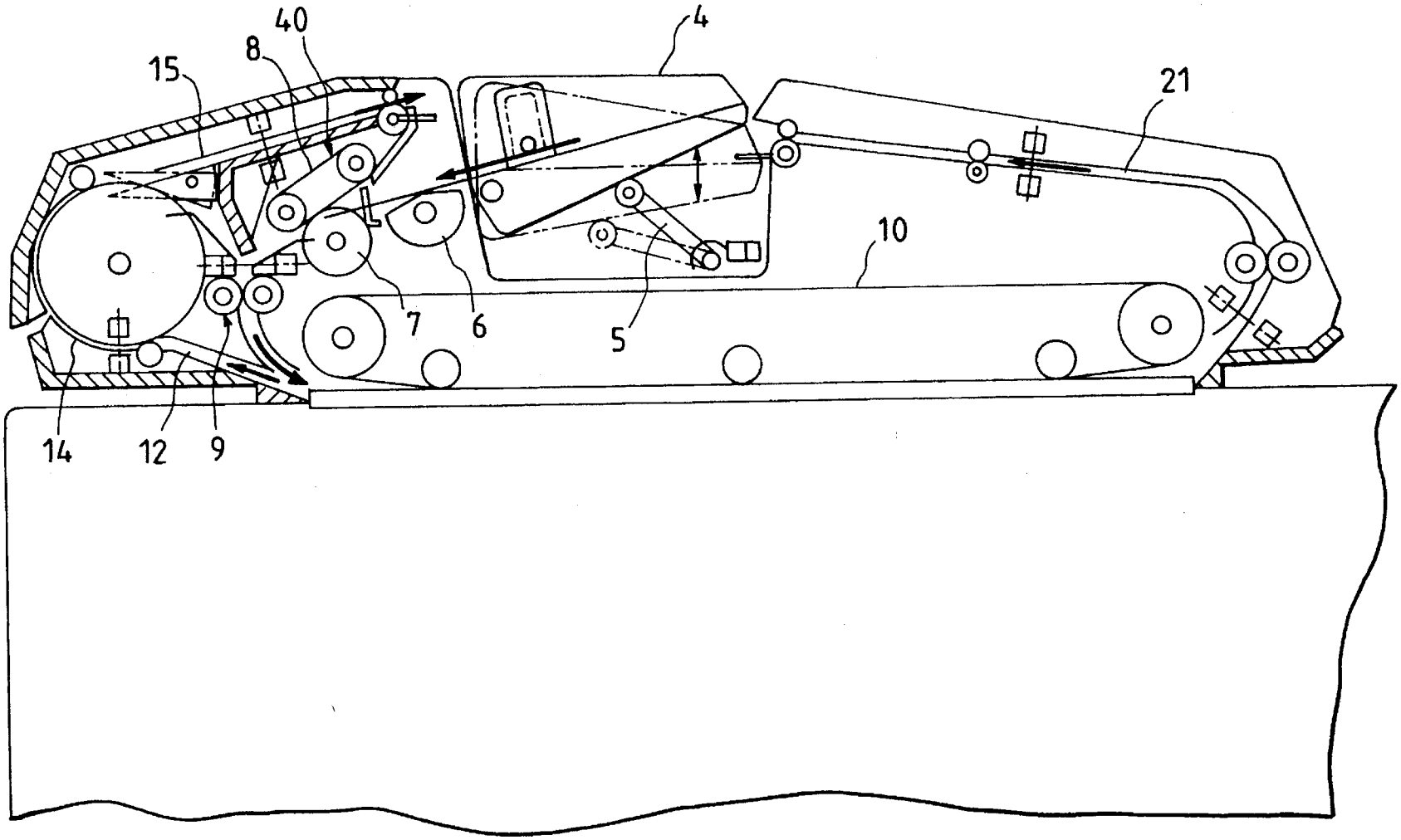
FIG. 2 is a sectional view of the sheet supplying apparatus mainly showing a sheet supply path and a sheet discharge path.

Further, a convey path 21 is connected to a right end of the platen 2 through a jump portion 20, and a pair of discharge rollers 22*a*, 22*b* are disposed at a free end of the convey path 21. That is to say, as shown in FIG. 2 and as mentioned above, the tray acts as the sheet stacking plate and as the sheet discharge plate. The tray 4, sheet supply roller 6, convey roller 7, separation belt 8, regist rollers 9 and endless belt 10 constitute a convey means for conveying the sheet original P (FIG. 1), the convey path 21 constitutes a first convey path, and the convey paths 12, 14, 15 constitute a second convey path.

Further, when the tray 4 is positioned at a position shown by the solid line, it acts as the sheet stacking plate and as the sheet discharge plate for the second convey paths 12, 14, 15; whereas, when the tray is positioned at a position shown by the two dot and chain line, it acts as the sheet discharge plate for the first convey path 21. Incidentally, as mentioned above, the tray 4 can be shifted between the positions shown by the solid line and the two dot and chain line.

The construction of the sheet supplying apparatus and a flow of the sheet in the apparatus are as mentioned above.

Next, a sheet supply means 40 according to the present invention and a method for controlling the sheet supply means will be explained.

Figure 3:
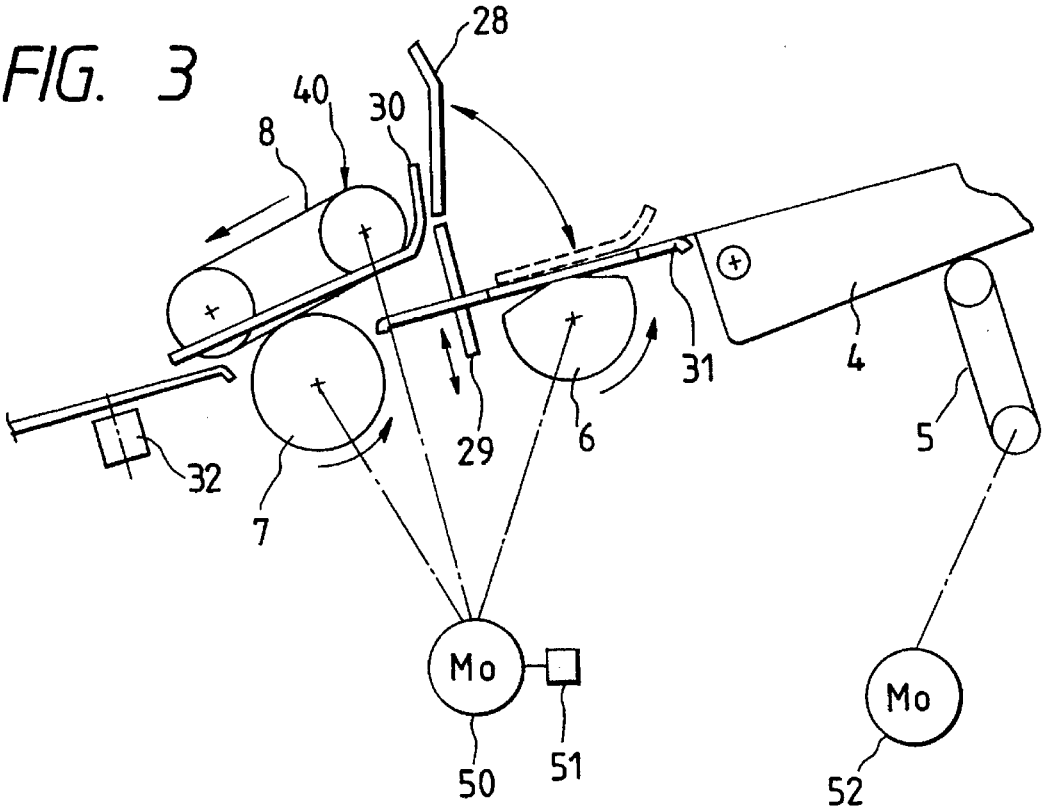
FIG. 3 is a view showing a sheet supplying station (separating station) in detail.

FIG. 3 shows the sheet supply means 40 in detail. In this sheet supply means, the sheet supply roller 6, convey roller 7 and separation belt 8 are rotated by a DC motor (sheet supply drive motor) 50 in directions shown by the arrows, respectively, and a weight 28 for urging against the sheet supply roller 6 can be shifted to a position shown by the broken line by a solenoid. The sheets are set on the trays 4, 31 in such a manner that one ends of the sheets are abutted against a shutter 29 which can be retracted below the sheet supply tray 31. A separation sensor 32 serves to detect the timing when the sheet passes through the sensor.

Figure 4:
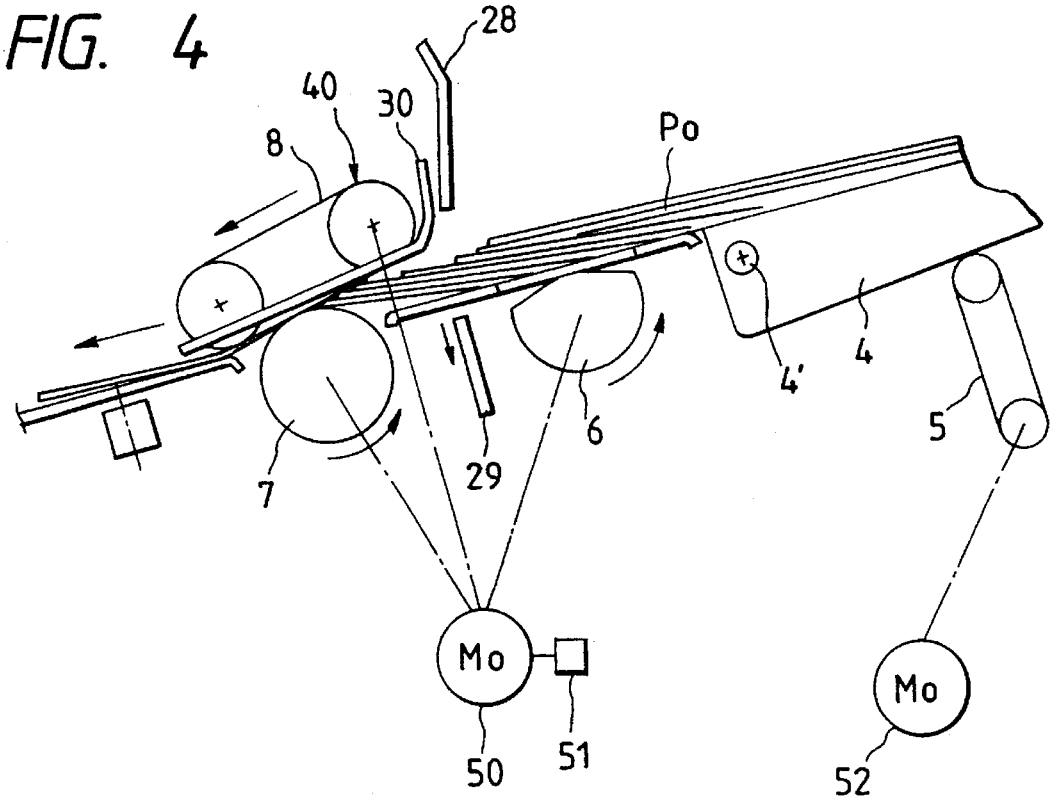
FIG. 4 is a view of the sheet supplying station showing a sheet supplying condition.

In a condition that the sheets are set on the trays 4, 31 while they are abutted against the shutter 29, when a copy start button is turned ON, as shown in FIG. 4, the shutter 29 is retracted by a plunger, and the sheet supply roller 6, convey roller 7 and separation belt 8 are rotated in the directions shown by the arrows, respectively, so that the sheet are supplied one by one from the lowermost one. As shown, bundled sheets Po which are not yet separated and disposed at an upstream side of the separation belt 8 are blocked by the separation belt 8 to form a tapered sheet stack. In such a condition, the sheets Po can be separated and supplied without any trouble, and, thus, the weight (urging means) 28 for increasing the conveying force of the sheet supply roller 6 is positioned at an upward waiting position, so that the conveying force of the sheet supply roller is obtained by the total weight of the sheets. If the total weight is insufficient to obtain the required conveying force because the number of sheets is small or if the coefficient of friction of the sheet supply is so reduced as not to obtained the required conveying force so that the sheet does not reach the separation sensor 32 within a predetermined time period, the weight 28 is lowered to the position shown by the broken line to urge the sheets against the sheet supply roller, thereby increasing the conveying force of the sheet supply roller to separate and supply the sheet positively (re-tray operation) (FIG. 5).

Figure 5:
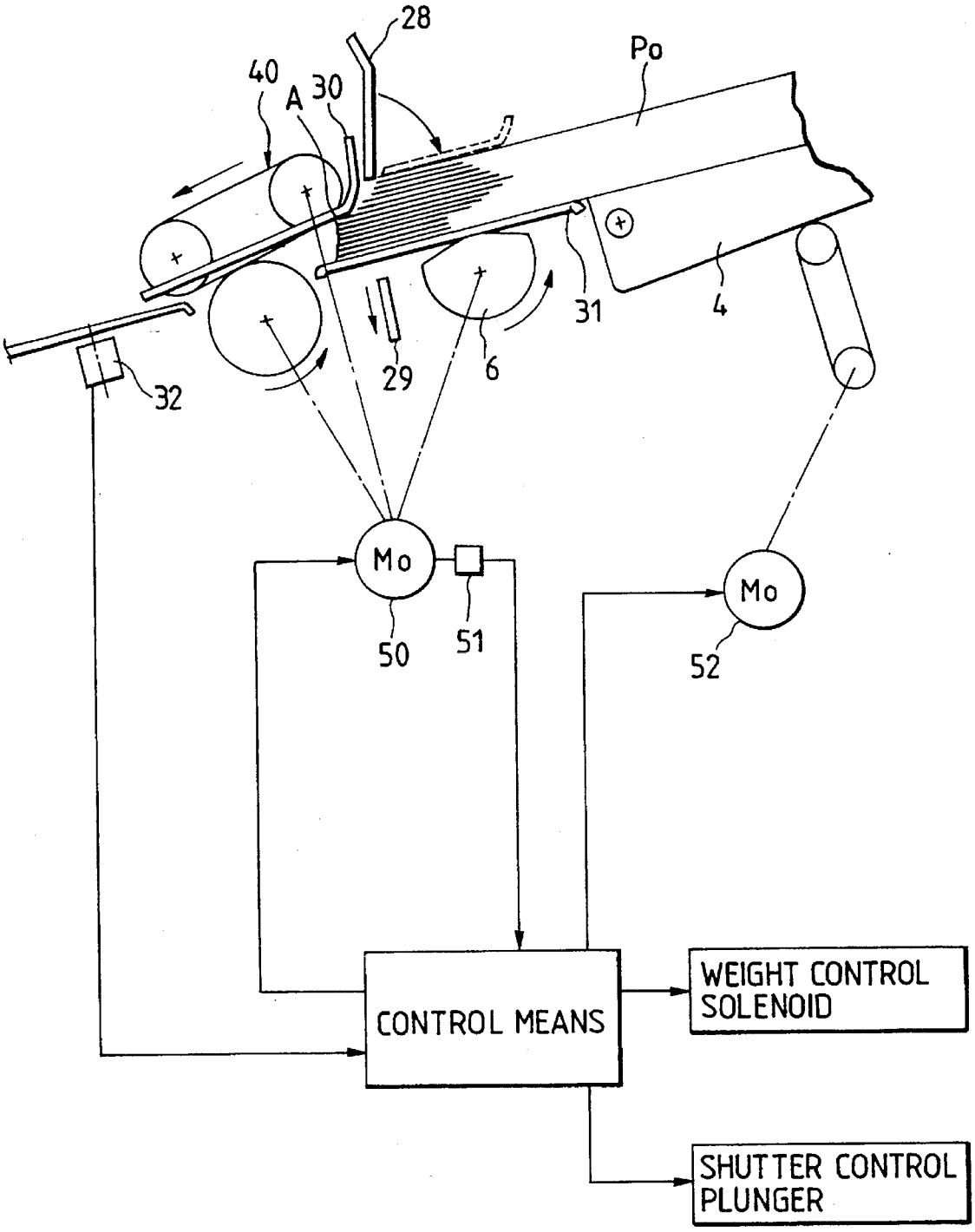
FIG. 5 is a view of the sheet supplying station showing a condition that a sheet stack is clogged in the sheet supplying station to cause a locked condition.

On the other hand, as shown in FIG. 5, when a large number (for example, 100 or more) of sheets Po are stacked, the contacting force between the sheets is increased due to the larger total weight of the sheets. In this condition, when the shutter 29 is retracted downwardly and the sheet supply roller 6 is rotated, the bundled sheets may be entered into a space between the separation regulating plate 30 defining the path at the separating station and the sheet supply roller 6 at a time, with the result that the sheets may be clogged in the path to cause a locked condition. In such a locked condition, even when the sheet supply roller is further rotated, since the sheet bundle is clogged in the separating station, any sheet cannot be conveyed downstreamly from the separating station, and thus, the sheet does not reach the separation sensor within the predetermined time period, as is in the above case. Accordingly, the weight 28 is lowered to the broken line position; however, since the sheet bundle is clogged in the separating station, any sheet cannot be further advanced.

Incidentally, the above-mentioned locking condition not necessarily occurs at the initiation of the sheet supplying operation, but may occur during the sheet supplying operation. Further, the locking condition may occur not only in the switch-back mode wherein the sheet is supplied in a condition that the tray 4 is positioned at the upper position but also in the closed-loop mode wherein the sheet is supplied in a condition that the tray 4 is positioned at the lower position.

If the locked condition occurs, even when the weight 28 is lowered to urge the sheet bundle Po against the sheet supply roller 6 (re-tray operation) and the sheet supply roller is rotated by the driving force from the DC motor 50, since the sheet bundle is clogged in the separating station at a point A not to supply any sheet, the rotational speed of the sheet supply roller is decreased, thereby greatly increasing the load acting on the sheet supply roller.

In the illustrated embodiment, the current flowing in the DC motor 50 for driving the sheet supply roller 6 is detected by a torque sensor 51 acting as a sheet supplying condition detecting means. That is to say, if the locking condition occurs, the weight 28 is firstly lowered to effect the re-tray operation. If the sheet cannot be supplied even by the re-tray operation, since the current of the DC motor 50 is increased due to the increased load of the sheet supply roller and exceeds a predetermined value, the value of the current is detected by the torque sensor to generate a detection signal (if the current exceeds the predetermined value) which is in turn sent to a controller, which judges that the locked condition occurs.

On the other hand, when the re-tray operation is effected in a condition that the locked condition does not occur, for example, when the friction of the sheet supply roller is lost, since the sheet supply roller is driven merely as idle rotation, the current of the DC motor does not exceed the predetermined value, unlike to the locked condition.

Figure 6:
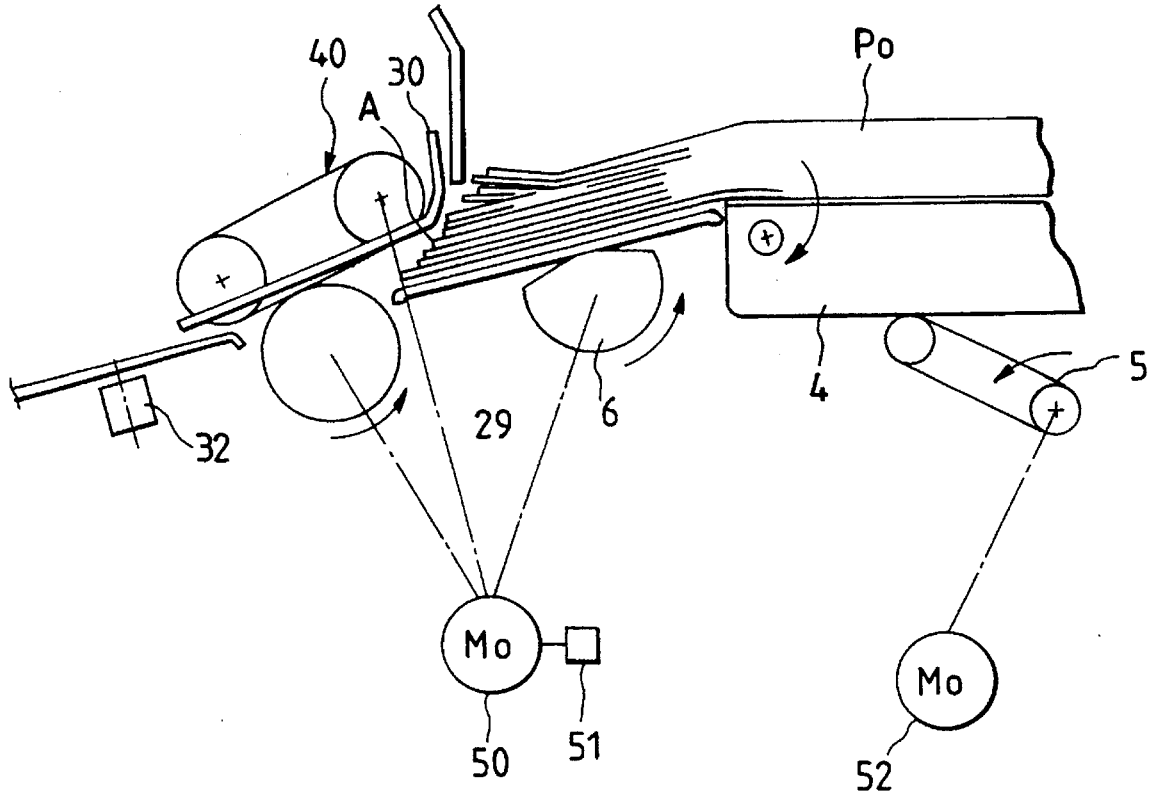
FIG. 6 is a view of the sheet supplying station showing a condition that the locked condition is eliminated.

When the locked condition is detected, as shown in FIG. 6, the separating operation is stopped by a signal from the controller, and the DC motor 52 and the associated lift/lower rink 5 are driven on the basis of a signal from the controller, with the result that the tray 4 is lowered, thereby bending the sheet bundle. Since the sheet bundle is thick and the shifted amounts of the respective sheets in the sheet bundle differ from each other, when the sheet bundle is bent, the sheets in the bundle are displaced along the sheet conveying direction, thereby releasing or eliminating the locked condition at the point A. Then, the tray 4 is lifted to the original position by the DC motor 52 and the associated lift/lower rink 5, and the sheet supplying operation is re-started.

Further, in the closed-loop mode wherein the tray 4 is lowered, if the locked condition is detected, the separating operation is also stopped. Then, the tray 4 is firstly lifted and then is lowered to eliminate the locked condition. Thereafter, the tray is returned to the original position, and the sheet supplying operation is re-started.

Next, the entire construction of the copying machine will be explained with reference to FIG. 7.

Figure 7:
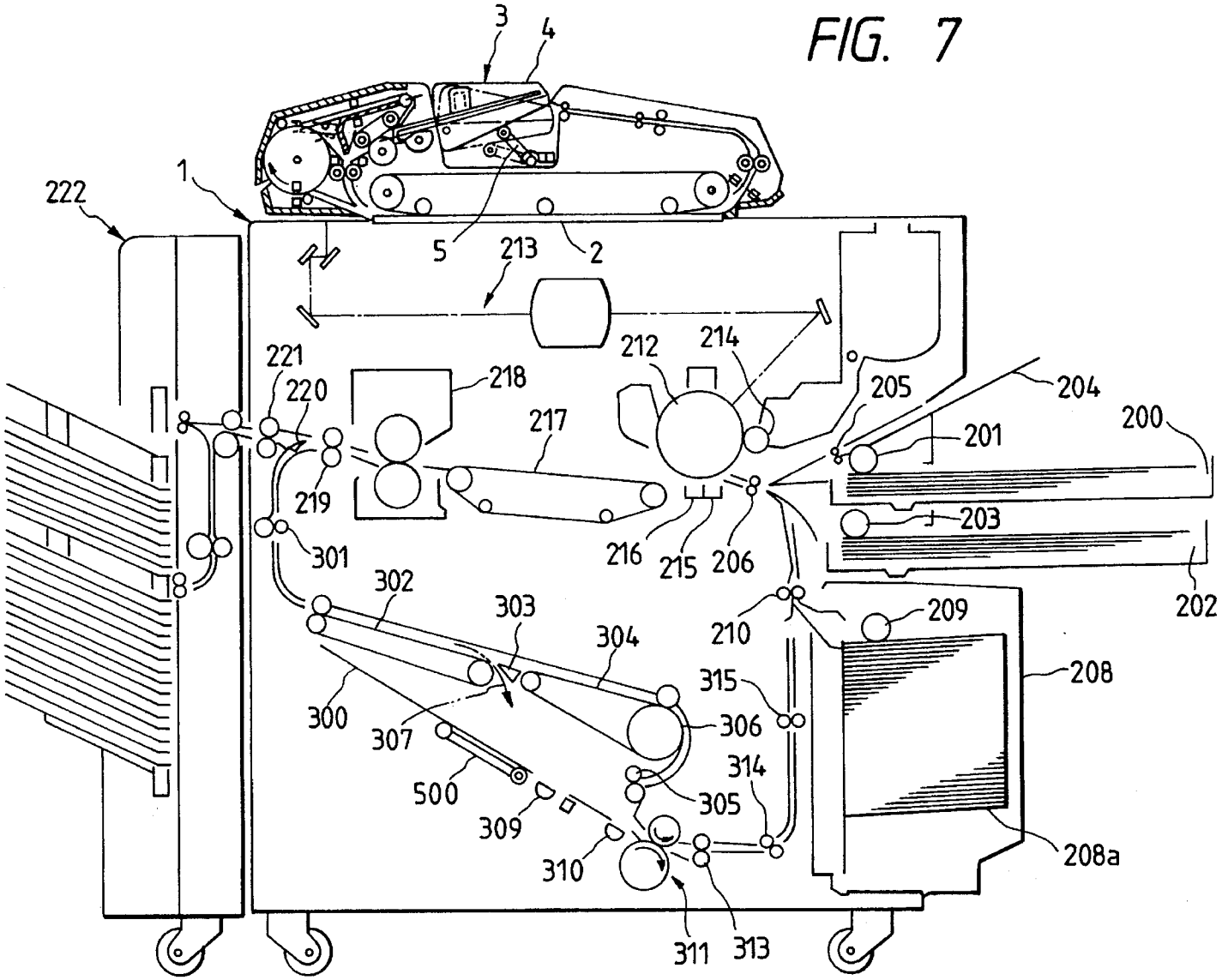
FIG. 7 is an elevational sectional view of an image forming apparatus (copying machine)

In FIG. 7, the copying machine contains an upper cassette 200, a lower cassette 202, and a manual insertion guide 204. Sheets (recording materials) in the upper cassette 200 are separated one by one by a separating pawl and a sheet supply roller 201 and the separated sheet is sent to a pair of regist roller 206. Sheets (recording materials) in the lower cassette 202 are separated one by one by a separating pawl and a sheet supply roller 203 and the separated sheet is sent to the pair of regist rollers 206. A sheet (recording material) inserted from the manual insertion guide 204 is sent to the pair of regist rollers 206 via a pair of rollers 205. A sheet (recording material) stacking device 208 of deck type has an intermediate plate 208*a* which can be lifted and lowered by a motor and the like and on which a plurality of sheets are stacked. The sheets on the intermediate plate are separated one by one by a sheet supply roller 209 and a separating pawl, and the separated sheet is sent to a pair of convey rollers 210.

Further, the copying machine has an image forming portion which is constituted by a photosensitive drum 212, a reading optical system 213, a developing device 214, a transfer charger 215 and a separation charger 216. Further, there are provided a convey belt 217 for conveying the sheet on which an image was formed, a fixing device 218, a pair of convey rollers 219, and a flapper 220. The sheet on which the image was formed is directed to a pair of discharge rollers 221 by the flapper 220 and then is discharged into a sorter. In place of the sorter, a discharge tray may be used.

An intermediate tray 300 serves to temporarily store the sheets on which the images were formed, when images are formed on both surfaces of each sheet (both-face copy mode) or when a plural images are formed on each sheet in a superimposed fashion (multi copy mode). A pair of convey rollers 301, a convey belt 302, a flapper 303, a convey belt 304 and a pair of convey rollers 305 are associated with the intermediate tray 300. In the both-face copy mode, the sheet is sent onto the intermediate tray 300 through a path 306. In this case, the sheet is rested on the intermediate tray with the imaged surface facing upwardly. In the multi copy mode, the sheet is sent onto the intermediate tray 300 through a path 307. In this case, the sheet is rested on the intermediate tray with the imaged surface facing downwardly. A rink 500 serves to swing or rock the tray 300 for releasing a locked condition of the sheets, similar to the above-mentioned rink 5.

The sheets stacked on the intermediate tray 300 are separated and re-supplied one by one from the lowermost one under the action of auxiliary rollers 309, 310 and a pair of reversible separation rollers 311. The separated sheet is sent to the image forming portion through convey rollers 313, 314, 315, the pair of convey rollers 210 and the pair of regist rollers 206. After the image forming operation is finished, the sheet is discharged in the same manner as mentioned above.

When the number of copies is determined regarding each sheet original set on the platen (platen glass) 2, first of all, the image is formed or copied on one surface of each of the sheets (recording materials) corresponding to the copy number, and then, these sheets are stacked on the intermediate tray 300. Thereafter, the sheet original in question is discharged from the platen glass 2 and is then introduced onto the platen glass 2 with the other surface thereof facing toward the platen. Then, the image on the other surface of the sheet original is copied on these sheets which are successively re-supplied from the intermediate tray 300, respectively. The sheets on which the images were formed on their both surfaces are successively discharged into the sorter 222 to be sorted in page order.

On the other hand, there is a method wherein one set of copies are obtained during one set of sheet originals are circulated by an original treating apparatus 3 having the above-mentioned sheet supplying apparatus. According to this method, even when a plurality of sets of copies are desired, since each of the copy sets wherein the copied sheets are arranged in page order can be obtained, the sorter can be omitted. When this method is used in the both-face copy mode, the images on the front and back surfaces of the first sheet original are successively copied on the front and back surfaces of the first sheet, respectively, and the copied sheet is discharged. Then, by repeating the same copying operation regarding the second sheet original, third sheet original and so on, the sorted sets of both-face imaged copies can be obtained.

(Alterations)

As an alteration, if the locked condition occurs, first of all, the weight 28 is lowered to urge the sheet bundle against the sheet supply roller 6 (re-tray operation). In this case, since the sheet bundle is clogged, any sheet is not further conveyed or supplied. When the sheet dose not reach the separation sensor 32 within the predetermined time period, it is judged that the locked condition occurs. Incidentally, in the illustrated embodiment, the sheet supplying condition detecting means is constituted by the weight (urging means) 28 and the separation sensor 32. In this sheet supplying condition detecting means, the torque sensor 51 in FIG. 5 is omitted.

When the locked condition of the sheet bundle is detected, as is in the above-mentioned embodiments, the separating operation is stopped, and the tray 4 is once lowered. As a result, the sheets in the bundle are displaced along the sheet conveying direction, thereby eliminating the locked condition. Then, the tray 4 is returned to the original position, and the sheet supplying operation is re-started.

Incidentally, in the above-mentioned embodiments, while an example that, when the locked condition of the sheet bundle is detected by the sheet supplying condition detecting means 51 or 28, 32, the drive means 5, 52 is operated on the basis of the detection signal from the sheet supplying condition detecting means was explained, the present invention is not limited to such an example, the drive means 5, 52 may be operated when a predetermined time period is elapsed after the initiation of the operation of the sheet supplying apparatus. In this case, the sheet bundle can be prevented from being locked or the locked condition of the sheet bundle can be automatically eliminated. That is to say, a timer operated in synchronous with the copy start button may be used. The timer cooperates with the control means for controlling the tray driving means.

Further, in the above-mentioned embodiments, while the trays 4, 31 were mounted in the inclined condition, the trays may be mounted in a horizontal condition. Incidentally, in the above-mentioned embodiments, while an example that the tray 4 is rocked only by one time was explained, the tray may be rocked by several times. In this case, the tray may be rocked slowly or may be vibrated.

Further, after the tray 4 is rocked by one time (or several times), if the locked condition is detected again, the tray 4 may be rocked again. In addition, the trays 4, 31 may be integrally formed with each other so that they are rocked together. In this case, the locked condition is eliminated by displacement of the tip end of the sheet bundle caused by the rocking movement and/or vibration of the trays 4, 31.

Next, a second embodiment of the present invention will be explained with reference to the accompanying drawings.

Figure 8:
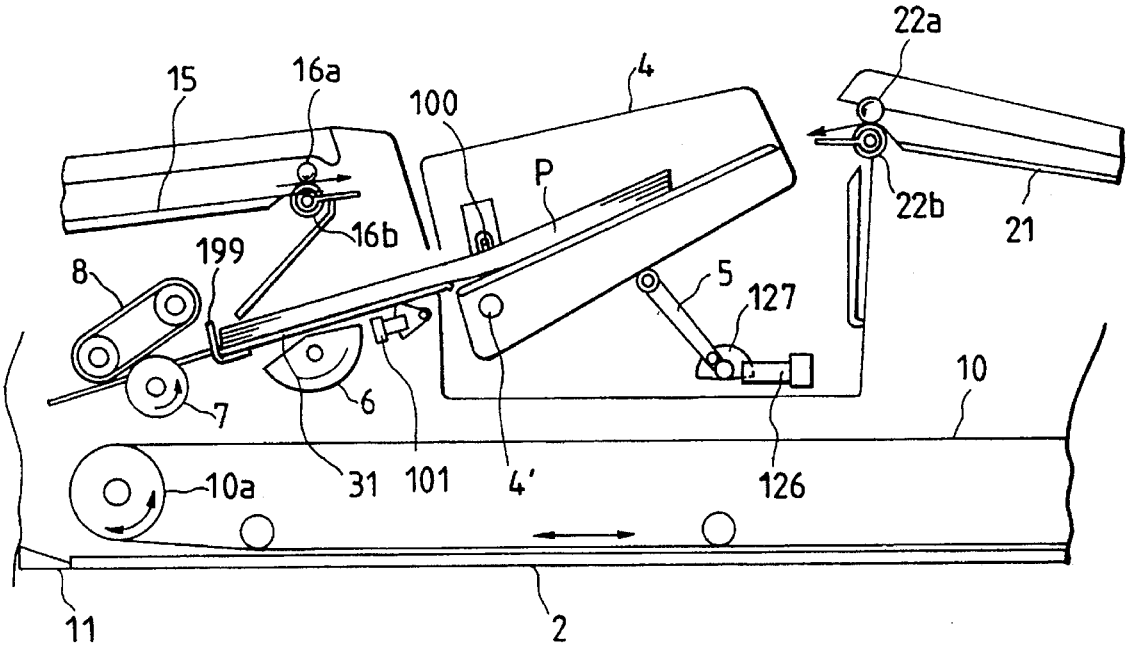
FIGS. 8 to 10 are partial sectional views of a sheet supplying apparatus according to a second embodiment of the present invention, for explaining a sheet supplying operation of the sheet supplying apparatus and a sheet conveying operation of an original treating apparatus.

FIG. 8 is a sectional view of an original treating apparatus having a sheet supplying apparatus according to a second embodiment of the present invention and mounted on a copying machine (image forming apparatus).

A sheet stopper 199 for regulating tip ends of sheets is arranged in the proximity of a front or downstream end (in a sheet conveying direction) of a tray 4. Further, below an inclined portion 31 of the tray 4, there is arranged a sheet detection sensor (sheet detection means) 101 for detecting the fact that the sheets P are stacked on the trays 4, 31. The sheet supplying apparatus is constituted by the tray 4, lift/lower rink 5, a sensor device comprised of sensor 126 and actuator 127, sheet supply roller 6, convey roller 7, separation belt 8 and sheet detection sensor 101.

Further, the original treating apparatus 3 having such a sheet supplying apparatus is provided with a partition lever 100 for separating the sheets firstly stacked on the tray 4 from sheets discharged onto the tray through a convey path (described later) after the copying operation.

Next, the sheet supplying operation of the sheet supplying apparatus and the sheet conveying operation of the original treating apparatus will be explained with reference to FIGS. 8 to 11.

Before the copying operation is started, as shown in FIG. 8, the tray 4 is positioned at an inclined sheet stacking position. In this condition, the operator sets the sheet originals on the tray 4 in such a manner that the sheets are abutted against the sheet stopper 199. In this case, since the tray 4 is inclined, the sheets P can automatically be aligned with each other by being slid down due to their own weights.

Figure 9:
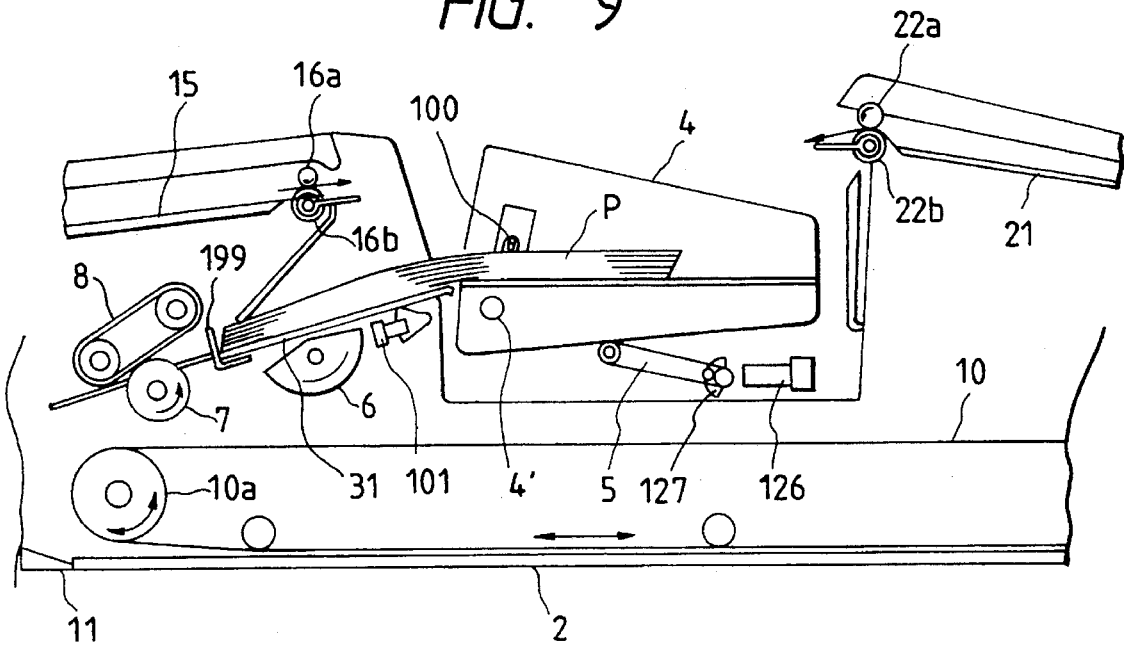
Figure 10:
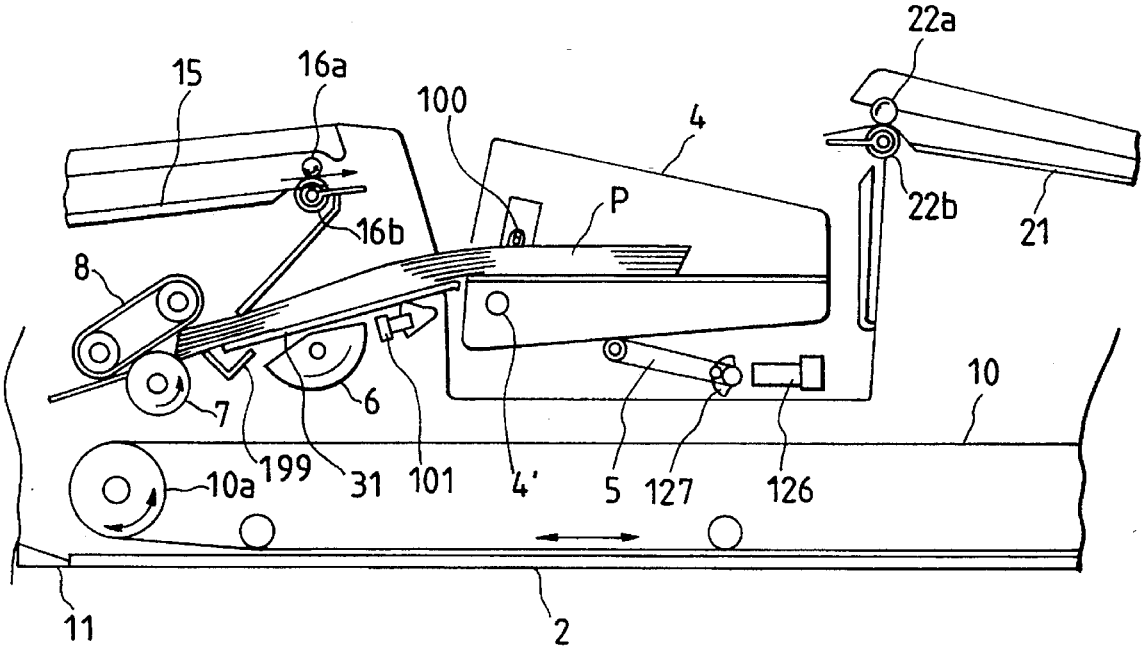
Figure 11:
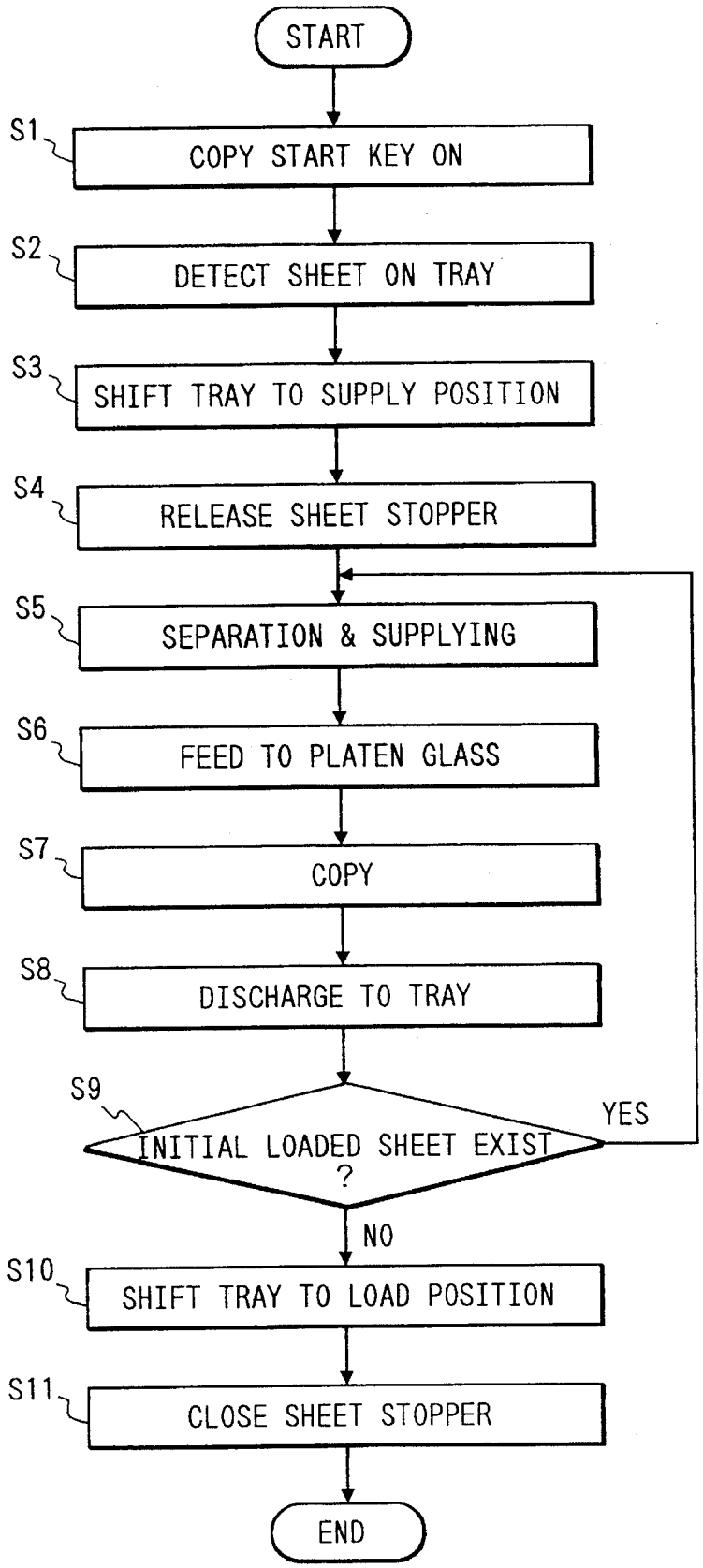
FIG. 11 is a flow chart for explaining the sheet supplying operation of the sheet supplying apparatus and the sheet conveying operation of the original treating apparatus.

In this condition, when a copy start key (not shown) of the copying machine is turned ON (step S1) and the fact that the sheets P are stacked on the tray 4 is detected by the sheet detection sensor 101 (step S2), as shown in FIG. 9, the tray 4 is shifted to a substantially horizontal sheet supply position by the lift/lower rink 5 (step S3). Then, the sheet supply roller is pre-rotated to treat the sheets and, at the same time, side plates effect jogging movement, thereby aligning the sheets completely. Thereafter, as shown in FIG. 10, the sheet stopper 199 is lowered to open a sheet path (step S4), and the separation and supply means constituted by the sheet supply roller 6, convey roller 7 and separation belt 8 is operated to separate and supply the sheet from the sheet bundle P by one by one from the lowermost one (step S5).

In this case, since the tray 4 is positioned in the substantially horizontal position, the sliding-down force of each sheet due to its own weight is reduced so that the sheet bundle P can be prevented from excessively penetrating between the convey roller 7 and the separation belt 8, thereby preventing the poor separation and poor sheet supply.

The separated sheet supplied from the tray 4 is conveyed to a predetermined copying position on a platen 2 by the pair of regist roller 9 and endless belt 10. After the copying operation, the sheet is discharged onto the horizontal tray 4 (steps S6 to S8).

After all of the sheets P firstly stacked on the tray 4 were treated for the copying operation, the tray 4 is shifted to the stacking position shown in FIG. 8 (steps S9 and S10), and the sheet stopper 199 is lifted to close the convey path (step S11). Then, the operator can remove the sheets from the tray 4.

Figure 12A:
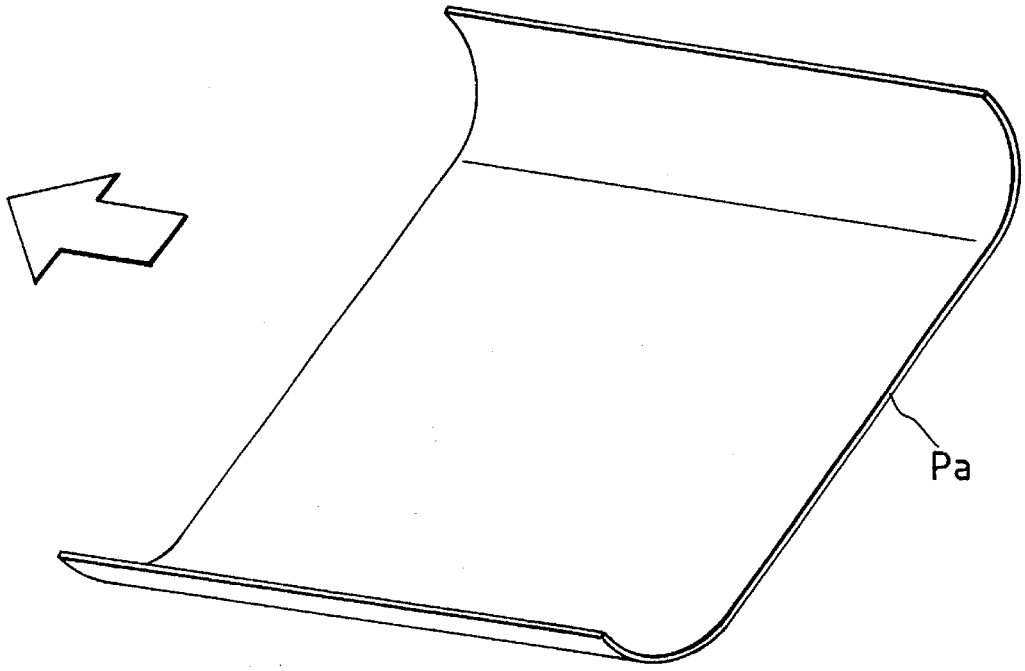
FIGS. 12A and 12B are views for explaining a condition that a sheet curled at its both side edges is treated by the sheet supplying apparatus.
Figure 12B:
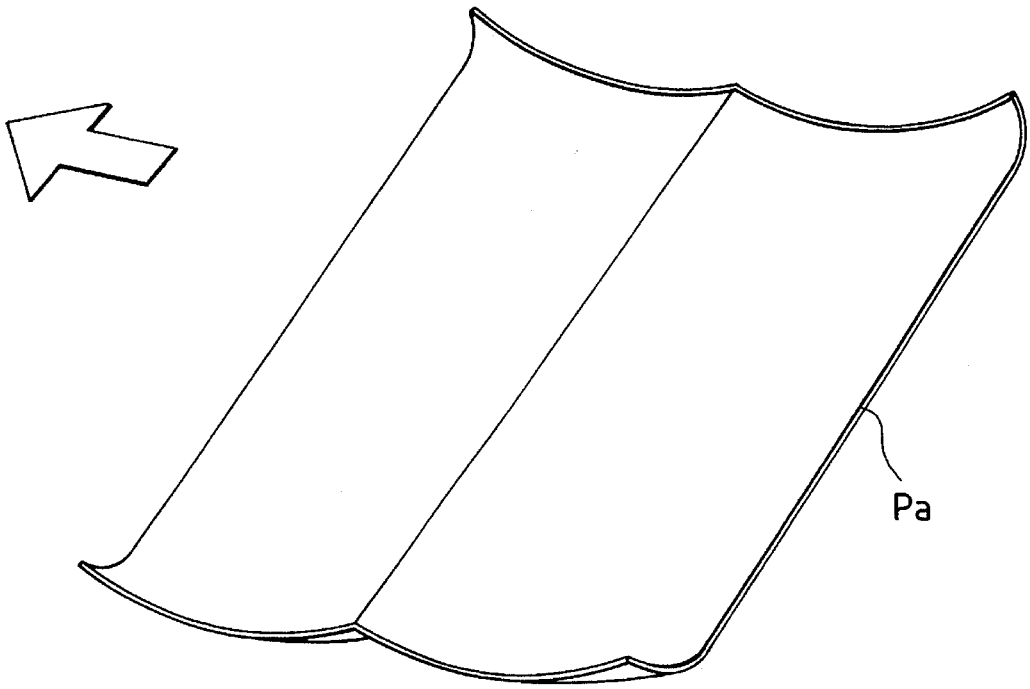

By the way, since the tray 4 has the inclined portion 31, when the tray 4 is shifted to the substantially horizontal sheet supply position as shown in FIGS. 9 and 10, the sheet bundle P on the tray 4 is bent to an upward-convex configuration having a bent line perpendicular to the sheet conveying direction. As a result, if each sheet Pa is curled at its both edge portions as shown in FIG. 12A, the curls are corrected by forming the bent line as shown in FIG. 12B, so that the sheet being supplied can be prevented from being caught by the convey roller 7 or the separation belt 8, thereby ensuring the positive sheet supply. That is to say, the poor separation and poor sheet supply due to the curl can be prevented.

(Alterations)

The sheet supply apparatus according to the second embodiment can be applied to the structure of the intermediate tray 300 of the aforementioned copying machine 1.

Figure 13:
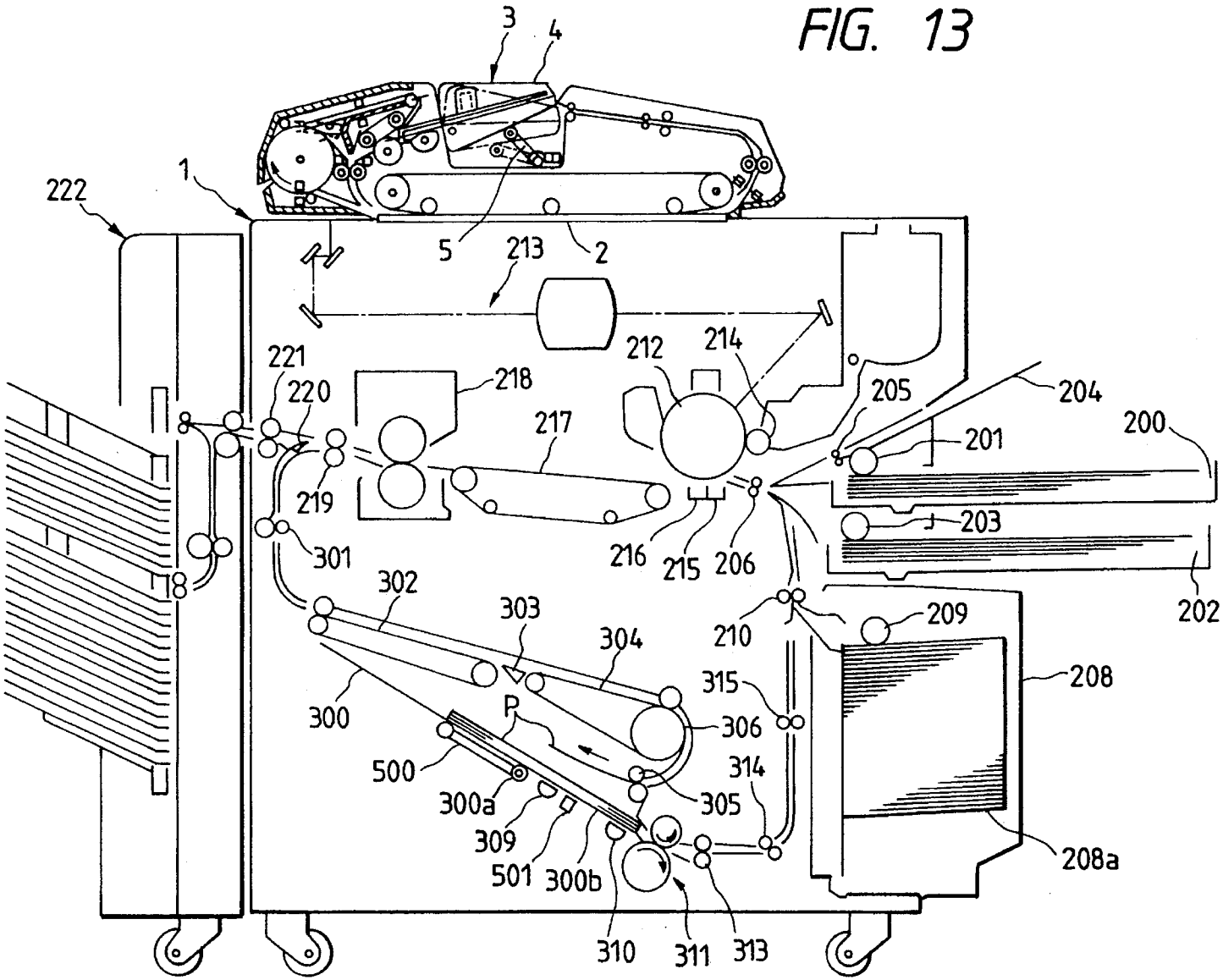
FIG. 13 is an elevational sectional view of a copying machine incorporating an alteration of the sheet supplying apparatus of the second embodiment.
Figure 14:
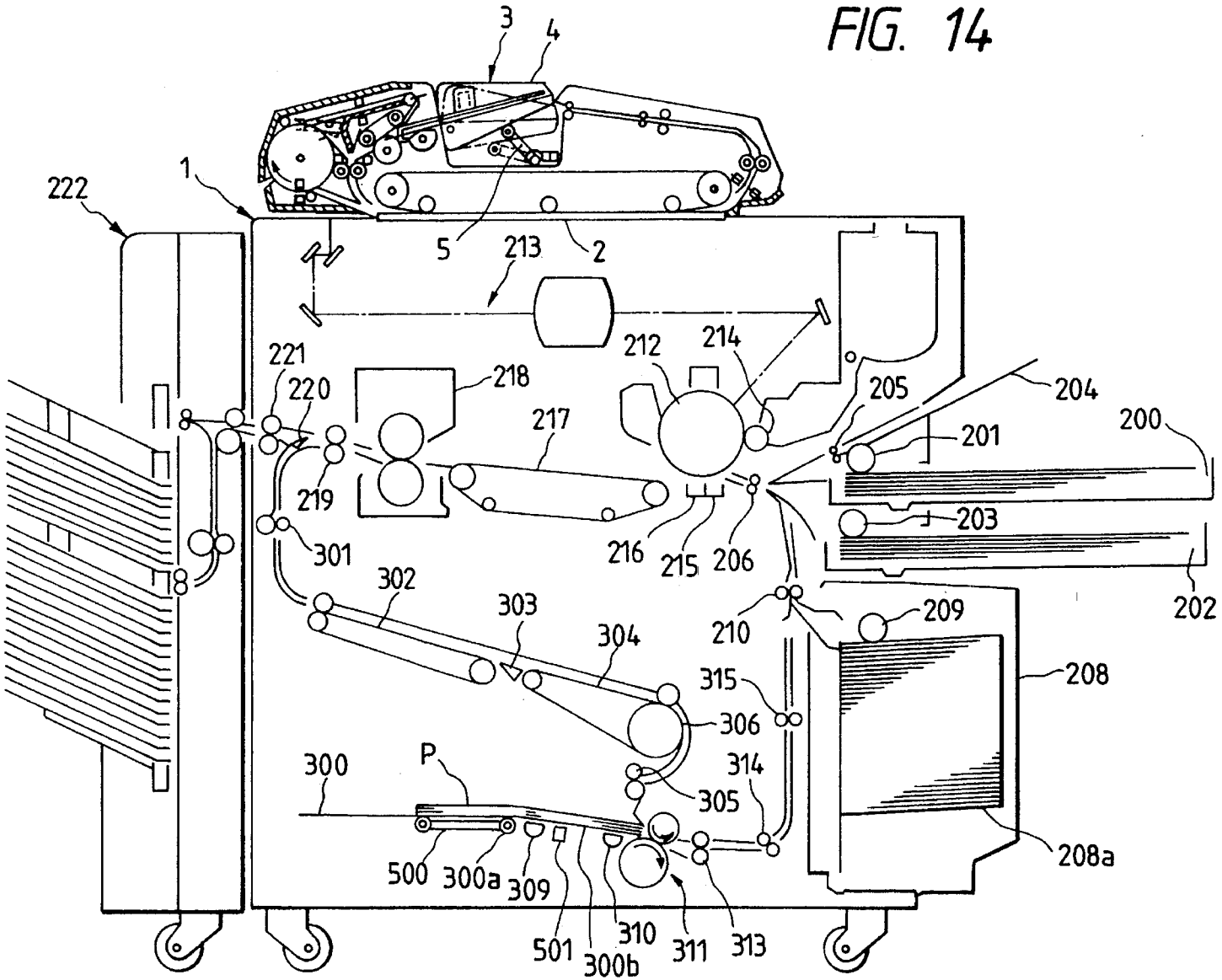
FIG. 14 is an elevational sectional view of the copying machine for explaining an operation of the sheet supplying apparatus.
Figure 15:
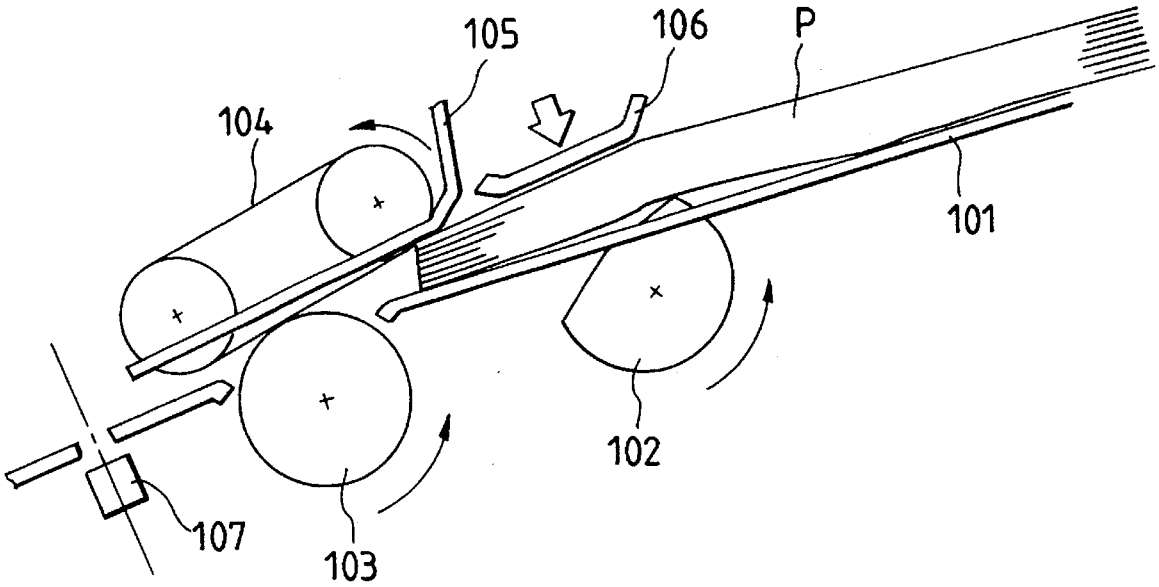
FIG. 15 PRIOR ART
FIG. 15 is a side view of a main portion of a conventional sheet supplying apparatus.

FIGS. 13 and 14 are sectional views of the copying machine having a sheet supplying apparatus according to such an alteration.

As shown, in the sheet supplying apparatus according to the alteration, the intermediate tray 300 also acts as a sheet stacking plate and a sheet discharge plate, and the auxiliary rollers 309, 310 and the pair of reversible separation rollers 311 arranged in the proximity of a downstream end of the intermediate tray 300 act as sheet separation and supply means. The intermediate tray 300 is pivotally mounted on a support shaft 300*a* so that the tray can be shifted between a sheet stacking position (FIG. 11) inclined toward the sheet supplying direction and a substantially horizontal sheet supply position (FIGS. 12A and 12B) by a lift/lower link (stacking plate drive means) 500. Further, an inclined portion 300*b* always inclined downwardly toward the sheet supplying direction is formed on the downstream end of the intermediate tray 300. In addition, a sheet detection sensor (sheet detection means) 501 for detecting the fact that the sheets (recording materials) P are stacked on the intermediate tray 300 is arranged below the inclined portion 300*b*.

In the copying machine 1 having the above-mentioned construction, the sheets P each having a first surface on which the image was formed are successively stacked on the intermediate tray 300 through the convey rollers 301, convey belt 302, flapper 303, convey belt 304, path 306 and convey rollers 305. In this case, the intermediate tray 300 is in the inclined sheet stacking position. Accordingly, the alignment of the sheets stacked on the intermediate tray 300 can be improved.

In this condition, when a predetermined number of sheets are stacked on the intermediate tray 300 and the sheet bundle is detected by the sheet detection sensor 501, as shown in FIG. 14, the intermediate tray 300 is shifted to the substantially horizontal sheet supply position by the lift/lower link 500. Thereafter, the auxiliary rollers 309, 310 and the pair of reversible separation rollers 311 separation and supply means are rotated to separate and supply the sheets from the sheet bundle one by one from the lowermost one.

In this case, since the intermediate tray 300 is positioned in the substantially horizontal condition, the sliding-down force of each sheet due to its own weight is reduced so that the sheet bundle P can be prevented from excessively penetrating between the pair of reversible separation rollers 311, thereby preventing the poor separation and poor sheet supply. Further, since the intermediate tray 300 has the inclined portion 300*b*, as is in the above-mentioned example, even if each sheet is curled at its both edge portions, the curls are corrected by bending the sheets, so that the sheet being supplied can be prevented from being caught by the pair of reversible separation rollers 311, thereby ensuring the positive sheet supply. That is to say, the skew-feed, poor separation and poor sheet supply due to the curls can be prevented.

Incidentally, in the above-mentioned embodiments, the sheet stacking positions of the tray 4 and the intermediate tray 300 may not necessarily be substantially horizontal, but may be inclined by an angle smaller than that of the sheet supply positions.

In the image forming apparatus according to the second embodiment, when the sheets are set, the sheet stacking plate is positioned at the sheet stacking position so that the stacking plate is inclined downwardly toward the sheet supplying direction. As a result, the sheets stacked on the stacking plate can be slid down on the stacking plate by their own weights to be easily aligned with each other. Further, when the sheet is supplied, the sheet stacking plate is shifted to the sheet supply position by the stacking plate drive means to eliminate or reduce the inclination of the sheet stacking plate. In this way, the sliding-down force of each sheet due to its own weight is reduced so that the sheet bundle can be prevented from excessively penetrating into the separation and supply means, thereby preventing the poor separation and poor sheet supply.

Further, since the sheet stacking plate has the inclined portion, when the sheet stacking plate is shifted to the sheet supply position having less or no inclination, the sheet bundle is bent to an upward-convex configuration having a bent line perpendicular to the sheet supplying direction. As a result, if each sheet is curled at its both edge portions, the curls are corrected by forming the bent line, so that the sheet being supplied can be prevented from being caught by the separation and supply means, thereby ensuring the positive sheet supply. That is to say, the poor separation and poor sheet supply due to the curl can be prevented.

What is claimed is:

1. A sheet supplying apparatus comprising:

a sheet stacking plate on which sheets are stacked;

drive means for vibrating said sheet stacking plate upwardly and downwardly;

sheet supply means for supplying the sheet from said sheet stacking plate to a predetermined position; and sheet supplying condition detecting means for detecting a poor supply of a sheet bundle, wherein said drive means is operated on the basis of a detection signal of said sheet supplying condition detecting means.

2. A sheet supplying apparatus according to claim 1, wherein said sheet supplying condition detecting means detects a load acting on said sheet supply means, and, when a detected value of said load exceeds a predetermined value, said drive means is operated.

3. A sheet supplying apparatus according to claim 2, wherein said sheet supplying condition detecting means is a torque sensor for detecting a value of current flowing in a sheet supply drive motor constituting a part of said sheet supply means.

4. A sheet supplying apparatus according to claim 1, wherein said sheet supplying condition detecting means is a separation sensor, and wherein, when the sheet is not detected by said separation sensor at a predetermined timing, said drive means is operated.

5. A sheet supplying apparatus according to claim 1, wherein said sheet supplying condition detecting means comprises a separation sensor disposed at a downstream side of said sheet supply means in a sheet supplying direction, and urging means for increasing a sheet supplying force of said sheet supply means, and wherein, when the sheet does not reach said separation sensor after a predetermined time period is elapsed during the operation of said sheet supply means, said urging means is operated, and, if the sheet is not detected by said separation sensor when a predetermined time period is elapsed after said urging means was operated, said drive means is operated.

6. A sheet supplying apparatus according to claim 1, wherein said sheet stacking plate can be shifted between a sheet stacking position inclined downwardly toward a sheet supplying direction and a sheet supply position not inclined or inclined smaller than said sheet stacking position, and wherein, when the sheets stacked on said sheet stacking plate positioned at said sheet stacking position are supplied, said sheet stacking plate is shifted from said sheet stacking position to said sheet supply position.

7. A sheet supplying apparatus according to claim 1, wherein said sheet stacking plate is a tray and has a sheet detection sensor for detecting the fact that the sheets are stacked on said tray, and wherein said tray can be shifted between a sheet stacking position inclined downwardly toward a sheet supplying direction, and further wherein, when the fact that the sheets are stacked on said tray positioned at said sheet stacking position and the sheets are supplied, said tray is shifted from said sheet stacking position to said sheet supply position.

8. A sheet supplying apparatus comprising:

a sheet stacking plate on which sheets are stacked;

drive means for vibrating said sheet stacking plate upwardly and downwardly; and sheet supply means for supplying the sheet from said sheet stacking plate;

wherein said drive means is operated when a predetermined time period is elapsed after a sheet supplying operation is started.

9. A sheet supplying apparatus comprising:

a sheet stacking plate on which sheets are stacked, said sheet stacking plate being divided into an upstream portion and a downstream portion so that the upstream portion can be rocked to bend a bundle of sheets between said upstream and downstream portions;

drive means for rocking said sheet stacking plate upwardly and downwardly;

sheet supply means for supplying the sheet from said sheet stacking plate to a predetermined position; and sheet supplying condition detecting means for detecting poor supply of a sheet bundle, said drive means being operated on the basis of a detection signal of said sheet supplying condition detecting means.

10. A sheet supplying apparatus according to claim 9, wherein said sheet supplying condition detecting means detects a load acting on said sheet supply means, and, when a detected value of said load exceeds a predetermined value, said drive means is operated.

11. A sheet supplying apparatus according to claim 10, wherein said sheet supplying condition detecting means is a torque sensor for detecting a value of current flowing in a sheet supply drive motor constituting a part of said sheet supply means.

12. A sheet supplying apparatus according to claim 9, wherein said sheet supplying condition detecting means is a separation sensor, and wherein, when the sheet is not detected by said separation sensor at a predetermined timing, said drive means is operated.

13. A sheet supplying apparatus according to claim 9, wherein said sheet supplying condition detecting means comprises a separation sensor disposed at a downstream side of said sheet supply means in a sheet supplying direction, and urging means for increasing a sheet supplying force of said sheet supply means, and wherein, when the sheet does not reach said separation sensor after a predetermined time period is elapsed during the operation of said sheet supply means, said urging means is operated, and, if the sheet is not detected by said separation sensor when a predetermined time period is elapsed after said urging means was operated, said drive means is operated.

14. A sheet supplying apparatus according to claim 9, wherein said sheet stacking plate can be shifted between a sheet stacking position inclined downwardly toward a sheet supplying direction and a sheet supply position not inclined or inclined smaller than said sheet stacking position, and wherein, when the sheets stacked on said sheet stacking plate positioned at said sheet stacking position are supplied, said sheet stacking plate is shifted from said sheet stacking position to said sheet supply position.

15. A sheet supplying apparatus according to claim 9, wherein said sheet stacking plate is a tray and has a sheet detection sensor for detecting the fact that the sheets are stacked on said tray, and wherein said tray can be shifted between a sheet stacking position inclined downwardly toward a sheet supplying direction, and further wherein, when the fact that the sheets are stacked on said tray is detected while the tray is positioned at said sheet stacking position, and the sheets are to be supplied, the tray is shifted from said sheet stacking position to said sheet supply position.

16. A sheet supplying apparatus, comprising:

a sheet stacking plate on which sheets are stacked, said sheet stacking plate being divided into an upstream portion and a downstream portion so that said upstream portion can be rocked to bend a bundle of sheets between said upstream and downstream portion;

drive means for rocking said sheet stacking plate upwardly and downwardly; and sheet supply means for supplying the sheet from said sheet stacking plate;

wherein said drive means is operated when a predetermined time period is elapsed after a sheet supplying operation is started.

17. An image forming apparatus comprising:

a sheet stacking plate on which original sheets are stacked;

drive means for vibrating said sheet stacking plate upwardly and downwardly;

sheet supply means for supplying the original sheet from said sheet stacking plate to a predetermined position;

sheet supplying condition detecting means for detecting a poor supply of an original sheet bundle, wherein said drive means is operated on the basis of a detection signal of said sheet supplying condition detecting means; and an image forming unit for forming an image on a copy sheet whenever the original sheet is sent to the predetermined position by said sheet supply means.

18. An image forming apparatus according to claim 17, wherein said sheet supplying condition detecting means detects a load acting on said sheet supply means, and, when a detected value of said load exceeds a predetermined value, said drive means is operated.

19. An image forming apparatus according to claim 18, wherein said sheet supplying condition detecting means is a torque sensor for detecting a value of current flowing in a sheet supply drive motor constituting a part of said sheet supply means.

20. An image forming apparatus according to claim 17, wherein said sheet supplying condition detecting means is a separation sensor, and wherein, when the sheet is not detected by said separation sensor at a predetermined timing, said drive means is operated.

21. An image forming apparatus according to claim 17, wherein said sheet supplying condition detecting means comprises a separation sensor disposed at a downstream side of said sheet supply means in a sheet supplying direction, and urging means for increasing a sheet supplying force of said sheet supply means, and wherein, when the sheet does not reach said separation sensor after a predetermined time period is elapsed during the operation of said sheet supply means, said urging means is operated, and, if the sheet is not detected by said separation sensor when a predetermined time period is elapsed after said urging means was operated, said drive means is operated.

22. An image forming apparatus according to claim 17, wherein said sheet stacking plate can be shifted between a sheet stacking position inclined downwardly toward a sheet supplying direction and a sheet supply position not inclined or inclined smaller than said sheet stacking position, and wherein, when the sheets stacked on said sheet stacking plate positioned at said sheet stacking position are supplied, said sheet stacking plate is shifted from said sheet stacking position to said sheet supply position.

23. An image forming apparatus according to claim 17, wherein said sheet stacking plate is a tray and has a sheet detection sensor for detecting the fact that the sheets are stacked on said tray, and wherein said tray can be shifted between a sheet stacking position inclined downwardly toward a sheet supplying direction, and further wherein, when the fact that the sheets are stacked on said tray positioned at said sheet stacking position and the sheets are supplied, said tray is shifted from said sheet stacking position to said sheet supply position.

24. An image forming apparatus comprising:

a sheet stacking plate on which original sheets are stacked;

drive means for vibrating said sheet stacking plate upwardly and downwardly;

sheet supply means for supplying the original sheet from said sheet stacking plate to a predetermined position, wherein said drive means is operated when a predetermined time period is elapsed after an original sheet supplying operation is started; and an image forming unit for forming an image on a copy sheet whenever the original sheet is sent to a predetermined position on the platen by said sheet supply means.

25. An image forming apparatus, comprising:

a sheet stacking plate on which original sheets are stacked, said sheet stacking plate being divided into an upstream portion and a downstream portion so that said upstream portion can be rocked to bend a bundle of sheets between said upstream and downstream portions;

drive means for rocking said sheet stacking plate upwardly and downwardly;

sheet supply means for supplying the original sheet from said sheet stacking plate to a predetermined position;

sheet supplying condition detecting means for detecting a poor supply of an original sheet bundle, wherein said drive means is operated on the basis of a detection signal of said sheet supplying condition detecting means; and an image forming unit for forming an image on a copy sheet whenever the original sheet is sent to the predetermined position by said sheet supply means.

26. An image forming apparatus according to claim 25, wherein said sheet supplying condition detecting means detects a load acting on said sheet supply means, and, when a detected value of said load exceeds a predetermined value, said drive means is operated.

27. An image forming apparatus according to claim 26, wherein said sheet supplying condition detecting means is a torque sensor for detecting a value of current flowing in a sheet supply drive motor constituting a part of said sheet supply means.

28. An image forming apparatus according to claim 25, wherein said sheet supplying condition detecting means is a separation sensor, and wherein, when the sheet is not detected by said separation sensor at a predetermined timing, said drive means is operated.

29. An image forming apparatus according to claim 25, wherein said sheet supplying condition detecting means comprises a separation sensor disposed at a downstream side of said sheet supply means in a sheet supplying direction, and urging means for increasing a sheet supplying force of said sheet supply means, and wherein, when the sheet does not reach said separation sensor after a predetermined time period is elapsed during the operation of said sheet supply means, said urging means is operated, and, if the sheet is not detected by said separation sensor when a predetermined time period is elapsed after said urging means was operated, said drive means is operated.

30. An image forming apparatus according to claim 25, wherein said sheet stacking plate can be shifted between a sheet stacking position inclined downwardly toward a sheet supplying direction and a sheet supply position not inclined or inclined smaller than said sheet stacking position, and wherein, when the sheets stacked on said sheet stacking plate positioned at said sheet stacking position are supplied, said sheet stacking plate is shifted from said sheet stacking position to said sheet supply position.

31. An image forming apparatus according to claim 25, wherein said sheet stacking plate is a tray and has a sheet detection sensor for detecting the fact that the sheets are stacked on said tray, and wherein said tray can be shifted between a sheet stacking position inclined downwardly toward a sheet supplying direction, and further wherein, when the fact that the sheets are stacked on said tray positioned at said sheet stacking position and the sheets are supplied, said tray is shifted from said sheet stacking position to said sheet supply position.

32. An image forming apparatus comprising:

a sheet stacking plate on which original sheets are stacked, said sheet stacking plate being divided into an upstream portion and a downstream portion so that said upstream portion can be rocked to bend a bundle of sheets between said upstream and downstream portions;

drive means for rocking said sheet stacking plate upwardly and downwardly;

sheet supply means for supplying the original sheet from said sheet stacking plate to a predetermined position, wherein said drive means is operated when a predetermined time period is elapsed after an original sheet supplying operation is started; and an image forming unit for forming an image on a copy sheet whenever the original sheet is sent to a predetermined position on the platen by said sheet supply means.

33. An image forming apparatus according to any one of claims 17 to 25 and 32, further comprising a re-feed device for re-feeding the sheet to an image forming portion.

* * * * *

UNITED STATES PATENT AND TRADEMARK OFFICE

CERTIFICATE OF CORRECTION

PATENT NO. : 5,552,859 Page 1 of 2

DATED : September 3, 1996

INVENTOR(S) : Tomohito Nakagawa et al.

It is certified that error appears in the above-indentified patent and that said Letters Patent is hereby corrected as shown below: On the title page, item:

[73] ASSIGNEE:

"Canon Kabushiki Kaisha, Tokyo, Japan" should read --Canon Kabushiki Kaisha, Tokyo, Japan, and Nisca Corporation, Yamanashi-ken, Japan--.

COLUMN 4:

Line 3, "connected" should read --connected to--.
Line 43, "ends" should read --end--.
Line 54, "sheet" should read --sheets--.
Line 66, "obtained" should read --obtain--.

COLUMN 6:

Line 20, "roller" should read --rollers--.

COLUMN 7:

Line 15, "their both" should read --both of their--.
Line 37, "dose" should read --does--.

COLUMN 8:

Line 58, "by one" should read --one--.

UNITED STATES PATENT AND TRADEMARK OFFICE

CERTIFICATE OF CORRECTION

PATENT NO. : 5,552,859 Page 2 of 2

DATED : September 3, 1996

INVENTOR(S) : Tomohito Nakagawa et al.

It is certified that error appears in the above-indentified patent and that said Letters Patent is hereby corrected as shown below:

COLUMN 9:

Line 3, "roller" should read --rollers--.
Line 16, "its both" should read --both of its--.

COLUMN 10:

Line 9, "its both" should read --both of its--.
Line 40, "its both" should read --both of its--.

COLUMN 12:

Line 44, "portion;" should read --portions;--.

Signed and Sealed this

Twelfth Day of August, 1997

Bruce Lehman

*Attest:*

BRUCE LEHMAN

*Attesting Officer*

*Commissioner of Patents and Trademarks*